US007455023B2

(12) United States Patent
Gerstenberger

(10) Patent No.: US 7,455,023 B2
(45) Date of Patent: Nov. 25, 2008

(54) VESSEL HULL PROTECTION DEVICE

(76) Inventor: Peter J. Gerstenberger, 4806 Wilson Blvd., Arlington, VA (US) 22203

( * ) Notice: Subject to any disclaimer, the term of this patent is extended or adjusted under 35 U.S.C. 154(b) by 207 days.

(21) Appl. No.: 10/969,960

(22) Filed: Oct. 22, 2004

(65) Prior Publication Data

US 2006/0086302 A1 Apr. 27, 2006

(51) Int. Cl.
*B63B 21/12* (2006.01)

(52) U.S. Cl. ..... 114/221 R

(58) Field of Classification Search ..... 114/221 R, 114/222, 361; 417/423.3, 234
See application file for complete search history.

(56) References Cited

U.S. PATENT DOCUMENTS 3,044,410 A * 7/1962 Edmundson ..... 417/236
3,142,283 A * 7/1964 Fisher ..... 114/222
4,280,437 A * 7/1981 Jackson ..... 114/222
5,072,683 A * 12/1991 Colonna ..... 114/222
5,549,069 A * 8/1996 Faidi ..... 114/222
6,276,381 B1 * 8/2001 O'Brien ..... 135/87
6,340,198 B1 * 1/2002 Benites et al. ..... 296/136.1
6,401,829 B1 * 6/2002 Newton ..... 169/24
6,447,261 B1 * 9/2002 McCook ..... 417/234
6,840,192 B1 * 1/2005 Pagano ..... 119/254
7,013,821 B2 * 3/2006 Sakurai ..... 114/222

FOREIGN PATENT DOCUMENTS

DE 3806265 * 9/1989

* cited by examiner

*Primary Examiner*—Ed Swinehart
(74) *Attorney, Agent, or Firm*—Lowe Hauptman Ham & Berner, LLP

(57) ABSTRACT

A vessel protecting device is described including a cover and a fluid evacuating device. The cover, positioned surrounding the vessel in a fluid and attached solely to the vessel, encloses the vessel portion extending in the fluid. The fluid evacuating device, positioned between the cover and the vessel for removing fluid between the cover and the vessel, is accessible without removing the cover from the vessel. Further, a positioning member for positioning a fluid evacuating device for transporting fluid from between a vessel in a fluid and a cover positioned exterior to and surrounding the vessel is described. The positioning member includes a first member positionable substantially vertical and having a first end, a second end, and an attachment point for a fluid evacuating device, and a second member operatively connected to the second end of the first member away from the first end and extending from the first member.

47 Claims, 13 Drawing Sheets

VESSEL HULL PROTECTION DEVICE

FIELD OF THE INVENTION

The present invention relates to a vessel hull protection device.

BACKGROUND

Vessels, such as boats, ships, recreational watercraft, etc., suffer numerous deleterious effects due to contact with the fluid, i.e., water, in which the vessels operate. The effects include organism-based, e.g., barnacles, and electrical and/or chemical-based, e.g., wood rot, stray current and galvanic corrosion, effects upon the hull and other parts of the vessel. The conventional means of preventing or minimizing the effects involves removing the vessel from contact with water, i.e., to remove the vessel from the water in favor of storage on dry land.

Smaller vessels, such as boats and recreational watercraft, are often hauled out of water using trailers, boat lifting slings, or by forklifts and other such devices appropriate for removing the vessel from water and placing the vessel in dry storage. Larger vessels, such as ships, are moored in a dry dock location where the vessel is enclosed in a space forming a watertight chamber large enough for the vessel. Suitable size blocks support from beneath and make steady the vessel thereby allowing removal of water from the chamber via pumping or other mechanism resulting in dry storage of the vessel, e.g., a dry dock.

Other means of implementing dry storage of a vessel include suspending or raising vessels above contact with water by means of a lift. Smaller vessels, such as boats, are often raised from the water using various means in a location where they can be launched again. One approach is to install a derrick to raise the vessel by lifting bunkers beneath the vessel into contact with the vessel and raise the hull to a suitable height above the water. In other cases, the derrick uses fasteners attachable to a sling or fixed lifting points integral with the vessel and by securing the vessel as such the vessel is then raised away from the body of water a suitable distance and stored dry.

All of the aforementioned methods are used in one manner or another, however; these are not always convenient means for creating a dry storage condition due to a variety of logistical problems that come into effect such as those pertaining to time required to invoke such mechanisms, expense, availability of land or other resources for creating such storage, waterfront usage rules which may prohibit building or deploying such equipment, etc. For at least these reasons, in some cases it is more convenient for the owner of the vessel to leave the vessel moored or anchored and afloat in the body of water from whence the owner would re-launch the vessel.

Disadvantageously as described above, leaving the vessel exposed to water allows a variety of deleterious conditions to set in about the hull of the vessel and appendages connected both to and through the hull. These conditions include galvanic corrosion between dissimilar metals of the vessel having an electrical connection between them and where the water with which the metals contact acts as an electrolyte. Additionally, some vessels have electrically bonded metal fittings exposed through the vessel hull and contact with water by the fittings can act as a path to ground whenever those conditions are prevalent; stray current corrosion occurs in such instances between the vessel and ground by way of the exposed metal fitting.

Another deleterious condition is fouling of the vessel below the waterline related to marine plant and animal life affixing to the vessel's hull and/or appendages and whereby plant and animal growth adversely impacts the vessel's performance and further causes damage to the vessel. Another condition is foundering of the vessel in cases where a leak in the vessel below the waterline thereby allows water into the vessel causing the vessel to sink and/or cause significant damage to the vessel and potentially total loss of the vessel. Additionally, in some cases where tidal action beaches a vessel from time to time, the hull and appendages contact surfaces over which the vessel typically floats. Some of these surfaces can be muddy or comprised of other materials that can become imbedded in sea chests and other intake that feed systems can be damaged or whose performance may be affected if such material is fed to them.

Previous inventions utilizing a vessel hull cover can be divided into two basic categories. A first category secures a cover made of a flexible and "waterproof" material to the vessel itself by a securing mechanism depending on the vessel size and construction. The devices used range from simple lines acting as straps fastened topside to nailed battens in the case of wooden hulled ships of over a century ago.

The second category fastens the flexible, waterproof material to a frame apparatus of some sort positioned about the vessel whose principal aim is to ease the burden of deploying the hull cover. Some frame-based designs preclude light or rainwater from entering into the envelope itself.

In the former category, patents such as those issued to Duncan (U.S. Pat. No. 373,133, hereafter referred to as Duncan), Quimby (U.S. Pat. No. 623,961, hereafter referred to as Quimby), Farley (U.S. Pat. No. 632,919, hereafter referred to as Farley), Fisher (U.S. Pat. No. 3,142,283, hereafter referred to as Fisher), Liddell (U.S. Pat. No. 3,581,505, hereafter referred to as Liddell), Zondek (U.S. Pat. No. 3,761,334, hereafter referred to as Zondek), Cox (U.S. Pat. No. 4,026,233, hereafter referred to as Cox), and Preiser et al. (U.S. Pat. No. 4,046,094, hereafter referred to as Preiser) include enclosures for the bottom of vessels or parts thereof which are expressly designed to be entirely supported by rigging or means of fastening to attach the enclosure to the vessel and not to any other object such as a frame, dock, pier, pilings, or buoys when deployed as intended. None of the first category patents endeavor to remove water completely from between the entire vessel below the waterline and the enclosure. Nor are the enclosures designed with the intention to vacuum form fit to the dimensions of the vessel beneath the waterline while the vessel is afloat.

Duncan describes a cover applied to the length of the vessel to salvage ships that have run aground and foundered with holes in the hull below the waterline. The vessel supports the cover. Duncan fails to describe enclosing the entire hull and creating an envelope about the entire vessel, and the description of removing water between the hull and the cover by "squeezing" does not envision dry docking the vessel's entire hull while afloat.

Quimby describes a complete hull enclosure supported by the vessel and constructed from a waterproof fabric. Straps or ropes tied off at rings in the upper hem of the enclosure fasten the enclosure to cleats or other hardware mounted to the vessel. Quimby describes dewatering areas between the hull and the cover by means of pulling the case up tight in order to expel a portion of the water. Quimby further describes sealing off the case at the rear of the vessel by lacing the two open ends together to prevent an inflow of water. The cover is awkward to deploy in that the inventor describes teams in boats to deploy it, and in any case requires lacing the enclosure together about the stern of the vessel, which often enough will require some individual to get in the water to tie the enclosure. Quimby fails to describe using a pump or other siphoning or fluid evacuating device to lay up the entire hull in an effective dry dock condition.

Farley describes in one embodiment a jacket suspended by the vessel and encompassing the hull for the purpose of applying heat to the water within the jacket in which the ship's hull is enclosed. The heat destroys marine growth attached to the hull. Farley does not describe evacuating the hull or protecting metal parts from galvanic or stray current corrosion, nor would it provide such protection by leaving all parts exposed to water within the deployed jacket.

Fisher describes a hull enclosure completely supported by the vessel and also discusses applying a pump to remove brackish or saltwater from within the enclosure only to be replaced with freshwater. Fisher keeps the vessel encased in a bath of freshwater treated with chemical compounds to kill water-born plant and animal life. Because the vessel remains afloat in contact with water, Fisher does not protect propulsion and steering equipment from electrical or chemical effects.

Liddell describes a method for preventing fouling of barges, boats, piers and bulkheads among other objects by means of creating stagnant water zones. Battens are fastened atop the flexible waterproof material by a suitable securing mechanism, including nailing or screwing to wood structures and hulls. The intention is to reduce fouling of the structure by covering and leaving the water to stagnate within the space between the structure and the sectional covered area. The Liddell system is more awkward to deploy than many of the other approaches described herein. Battens need to be affixed about the hull while afloat presumably by a person getting into the water and working below the waterline of the vessel to attach the battens. The means of attaching the battens is cumbersome and uses nails or screws to affix the battens which may damage the vessel's hull. Such methods are inappropriate for other materials used to construct hulls such as fiberglass and metals. Furthermore, the cover envisioned by Liddell fails to offer protection against galvanic or stray current corrosion.

Zondek describes a means of covering a vessel's hull with metal foil for removing water from between a plate and the hull. The plates are held in place by adhesive and rolled onto the hull while the vessel is in dry dock. Zondek protects the hull only and not the propulsion equipment. In fact, the metal foil tends to aggravate stray current or galvanic corrosion. The metal foil is cumbersome to apply and remains in place for extended periods of time.

Cox describes a cover similar to Duncan in that a hole in the hull of a boat is temporarily shored from the vessel exterior by fitting a flexible material over the hole. The material is tied off to the bow of the boat and drapes back beneath the vessel's hull and covers the hole while retaining the material side edges above the waterline. The material stops short of the boat propulsion equipment enabling the propulsion equipment, if still operable, to drive the vessel and provide motion for applying pressure to the material covering the hull. The system is not intended to lay up the boat in a dry dock and is not used for storage or corrosion and fouling prevention.

Preiser et al. describes a method of suspending a shroud curtain about the periphery of a floating vessel. Pipes beneath the vessel pump in fresh water along the keel and the fresh water rises from the keel to the surface within the shroud curtain inhibiting marine growth. The method relies on using a large quantity of freshwater, which may be hard to come by and fails to inhibit the corrosive electrical conditions previously described.

In the latter category of prior approaches creating a structure or relying on a structure separate from the vessel, several prior approaches create enclosures about the bottom of vessels or parts thereof which are expressly designed to be entirely supported by rigging or means of fastening to attach the device to a frame or system not part of the vessel. Such frames or systems have been devised in a variety of ways including, but not limited to, connecting a flexible waterproof sheet to custom frames, docks, piers, pilings, or buoys when deployed as intended.

The latter category includes U.S. Patents issued to Wood (U.S. Pat. No. 3,685,477, hereafter referred to as Wood), Jackson (U.S. Pat. No. 4,282,822, hereafter referred to as Jackson), Eichert (U.S. Pat. No. 5,138,963, hereafter referred to as Eichert), Bradley (U.S. Pat. No. 5,152,242, hereafter referred to as Bradley), Perez-Collazo (U.S. Pat. No. 5,279,244, hereafter referred to as Perez-Collazo '244), Falcaro (U.S. Pat. No. 5,465,676, hereafter referred to as Falcaro), Faidi (U.S. Pat. No. 5,549,069, hereafter referred to as Faidi), and Perez-Collazo (U.S. Pat. No. 6,152,061, hereafter referred to as Perez-Collazo '061). Each of these references describe enclosures about the bottom of vessels or parts thereof expressly designed to be entirely supported by rigging or means of fastening attached to a frame or system not part of the vessel. As described above, the frame is designed for connection to a frame, dock, pier, etc.

Wood describes a floating, hinged frame connected to a dock and having a flexible bag attached to the frame. A hinged gate on one end of the frame is movable to provide access to and from the bag. Wood's device does not protect against electrical corrosion destroying propulsion and steering equipment and poses the general problems related to frame-type designs as described below.

Jackson describes another such device incredibly complex in its use of switches, inflatable toroidal bladders, pumping and ballasting systems for deploying a system which rises from beneath the vessel. Jackson's bladders fit the vessel periphery in an overlarge fashion and attach to the flexible material deploying them and forming the hull enclosure. The device fails to provide protection against galvanic and stray current corrosion. A pump-out evacuates seawater such that freshwater, treated with chemicals for preventing growth of marine born organisms, is introduced. The hole location for the pump's suction line is inflexibly located at a fixed location causing difficulties for deployment in a number of configurations. Depending on how the material fits the boat hull at any given time pockets of water may form in unwanted locations difficult or impossible to dewater and fail to provide sufficient lay up conditions to protect propulsion and control equipment of the vessel beneath the waterline from electrical corrosion or marine growth. Jackson fails to describe an additional system to dewater and includes an approach to dewatering the bag which facilitates substitution of sea water for freshwater.

Eichert describes a flexible hull enclosure as part of a more comprehensive maintenance facility. The enclosure keeps the vessel hull exposed to water within the enclosure and uses a pump with a drain hole and hose attached through the exterior of the material to remove sediment and debris removed from the vessel during painting and preservation work. The vessel is not protected from fouling or corrosion by use of the described complex enclosure.

Bradley, similar to Jackson above, describes an enclosure rising and falling from a position beneath the vessel in order to deploy or release the enclosure from use and relies on arrangements involving components other than the vessel for operation and support. Bradley describes a method for reducing hull fouling but fails to protect the metal components beneath the vessel's waterline from being subject to galvanic corrosion.

Perez-Collazo '244 describes a pulley system affixed to pilings in order to raise from beneath the vessel a flexible cover about the periphery of the vessel. The Perez-Collazo '244 system fails to evacuate water from contact with the hull and protect components beneath the waterline from galvanic corrosion.

Falcaro uses bubble wrap held up by buoyant PVC pipes filled with foam to produce a floating hull squeegee wiping the hull of debris each time the boat is launched from or docked to the device. The device fails to prevent the submersed metal components beneath the waterline from galvanic and stray current corrosion and fails to exsiccate the hull and remove the hull from contact with water. Hence, pockets of water are in contact with the hull which fails to prevent marine organism growth and development to the extent that the bubble wrap squeegee fails to dislodge them.

Faidi describes an external apparatus separate from the vessel and provides a frame structure to which the hull cover attaches in all described embodiments. Faidi employs a gate feature whereby the flexible material raises or lowers to allow entry of the vessel while held in place by the flexible material's frame structure separate from the vessel. Faidi, as with Jackson before him, describes pumping water from the interior of a frame fit enclosure and the hull of a boat with all that feature's attendant benefits; however, similar to Jackson, Faidi's system fits the flexible material to a frame apparatus, albeit one remaining above water rather than one which rises from beneath the water and vessel. Due to the use of a frame for support of the flexible material, Faidi requires comparatively more of the flexible material to cover the same size boat and thereby increases the cost of protecting the vessel. Additionally, Faidi's flexible material needs are larger than other frame fit enclosures in order to provide adequate room for docking the vessel while allowing for the cover to be completely pumped down, i.e., water removed from between the cover and vessel. Disadvantageously, in order to prevent stretching the material between the hull and the cover frame much more material is needed for the cover. If Faidi used less material, either the material would stretch at the periphery, thereby damaging the material or the frame more rapidly over time, or the frame holding the material in place would have to be smaller, increasing the difficulty of maneuvering in and out of the cover.

Perez-Collazo '061 describes another fixed deployment flexible hull cover system creating a floating bath environment treated with chemicals to inhibit marine growth. In addition to the above-described problems, the floating chemical bath fails to protect against galvanic corrosion of the vessel's water exposed metal parts.

As described above with respect to prior approaches, there are disadvantages to affixing hull covers to frames or structures separate from the vessel. In some instances, space limitations and minimal available room for deployment make installation or deployment awkward or not practical. Some approaches require creating complicated rigging systems made fast to piers, docks, bulkheads or other fixtures inaccessible or unusable for these purposes either because of construction, physical condition, or because permission from another party to make such arrangements is required.

In still other instances, ancillary structure-supported designs rely on electrical power and circuitry to operate pumps and switches as part of ballasting, pneumatic and hydraulic systems to create or deplete buoyancy of systems for deploying the system and setting the vessel into a lay up condition or providing for re-launching. Such additional circuitry adds complexity, increases cost, requires maintenance and replacement and creates a dependency such that a malfunctioning system may not work properly, if at all. A further disadvantage is that more material is required than in the previously described vessel supported hull cover systems. The additional material requirement is not just in the form of rigging, tackle, and construction materials for the frame, e.g., pontoons, floats, weights, brackets, pipes, hoses and other described hardware, but also in the amount of material required by the cover to encompass the hull depending on the dimensions of the frame structure with respect to the hull application.

Yet another disadvantage of separate frame structure systems is that they are subject to wave action imparting stress and abrasion on the flexible waterproof material as the cover floats independently of the vessel. This type of stress can rupture or damage the material thereby reducing or defeating the effectiveness of such designs.

Another disadvantage of separate frame structure systems is an awkwardness or inconvenience for a vessel operator in the course of maneuvering a vessel into such a system when the structure is set in a floating or otherwise suspended frame. Maneuvering a vessel is hazardous and cumbersome especially during docking and it is difficult enough to dock a vessel of any appreciable dimension during good conditions in a variety of common dock configurations, but a normal docking experience is only made worse by having the limited docking space even further reduced by installation of an additional frame structure within which the vessel is to be guided.

SUMMARY

An apparatus aspect includes a vessel hull protecting device including a cover positioned surrounding a vessel in a fluid and attached solely to the vessel and a fluid evacuating device. The cover encloses the vessel portion extending in the fluid. The fluid evacuating device is positioned between the cover and the vessel for removing fluid from between the cover and the vessel. The fluid evacuating device is accessible without removing the cover from the vessel.

Another apparatus aspect includes a vessel hull protecting device including a cover, a fluid evacuating device, a hollow positioning member, and a hose. The cover is positioned surrounding the vessel in a fluid and attached solely to the vessel. The cover encloses the vessel portion extending in the fluid and is at least substantially waterproof. The fluid evacuating device is positioned external to the cover for transporting fluid from between the cover and the vessel. The hollow positioning member has a first open end and a second open end. The first open end extends between the vessel and the cover enclosing the vessel portion extending in the fluid. The second open end extends above the fluid level external to the cover. The hose has a first open end and a second open end where the first open end is attachable to the hollow positioning member and the second open end of the hose is attachable to the fluid evacuating device.

Another apparatus aspect includes a positioning member for positioning a fluid evacuating device for transporting fluid from between a vessel in a fluid and a cover positioned exterior to and surrounding the vessel. The positioning member includes a first member positionable substantially vertical and having a first end and a second end. The first member has an attachment point for a fluid evacuating device. The positioning member further includes a second member operatively connected to a second end of the first member away from the first end and extending from the first member.

Another apparatus aspect includes a positioning member for transporting fluid from between a vessel in a fluid and a cover positioned exterior to and surrounding the vessel to a fluid evacuating device for transporting fluid. The positioning member includes a main hollow member and a lower hollow member. The main hollow member has a first open end and a second open end. The first open end of the main hollow member is positionable between the vessel and the cover enclosing the vessel portion extending in the fluid and the second open end of the main hollow member is positionable above the fluid level external to the cover. The lower hollow member has a first open end and a second open end and the first open end of the lower hollow member is operatively connected to the main hollow member between the first and second open ends of the main hollow member. The lower hollow member extends from the main hollow member. The second open end of the main hollow member is able to receive fluid from the lower hollow member.

A method aspect of protecting a vessel using a vessel protecting device including (a) a cover for surrounding a vessel in a fluid and attachable solely to the vessel, wherein the cover encloses the vessel portion extending in the fluid and (b) a fluid evacuating device positionable between the cover and the vessel for removing fluid from between the cover and the vessel, wherein the fluid evacuating device is accessible without removing the cover from the vessel, includes the steps of: positioning the cover to surround the vessel in the fluid; attaching a periphery of the cover to the vessel; positioning the fluid evacuating device within the cover positioned surrounding the vessel in the fluid; and activating the fluid evacuating device to remove fluid from between the cover and the vessel.

There are numerous advantages to the below-described vessel protection device.

An embodiment according to the present invention protects the hull and its appendages from deleterious effects by creating an effective dry dock condition by attaching a cover directly to the vessel rather than an exterior frame positioned around the vessel. The hull and any appendages extending from the hull are then evacuated by dewatering the interior of the cover. Without water, the galvanic and stray current corrosion conditions are prevented and water-born plant and animal life is prohibited. In addition, the vessel is free to settle onto a beach below the vessel during slack tide conditions without fear of the vessel damaging the material by stretching or rupturing.

Another embodiment according to the present invention provides a positioning member for positioning a fluid evacuating device for transporting fluid from between a vessel and a cover positioned on an exterior of the vessel. The positioning member enables positioning of the fluid evacuating device at or below a lowest level of a vessel and within a cover surrounding the vessel.

Still other advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention.

DESCRIPTION OF THE DRAWINGS

The present invention is illustrated by way of example, and not by limitation, in the Figures of the accompanying drawings, wherein elements having the same reference numeral designations represent like elements throughout and wherein.

DETAILED DESCRIPTION

Figure 1:
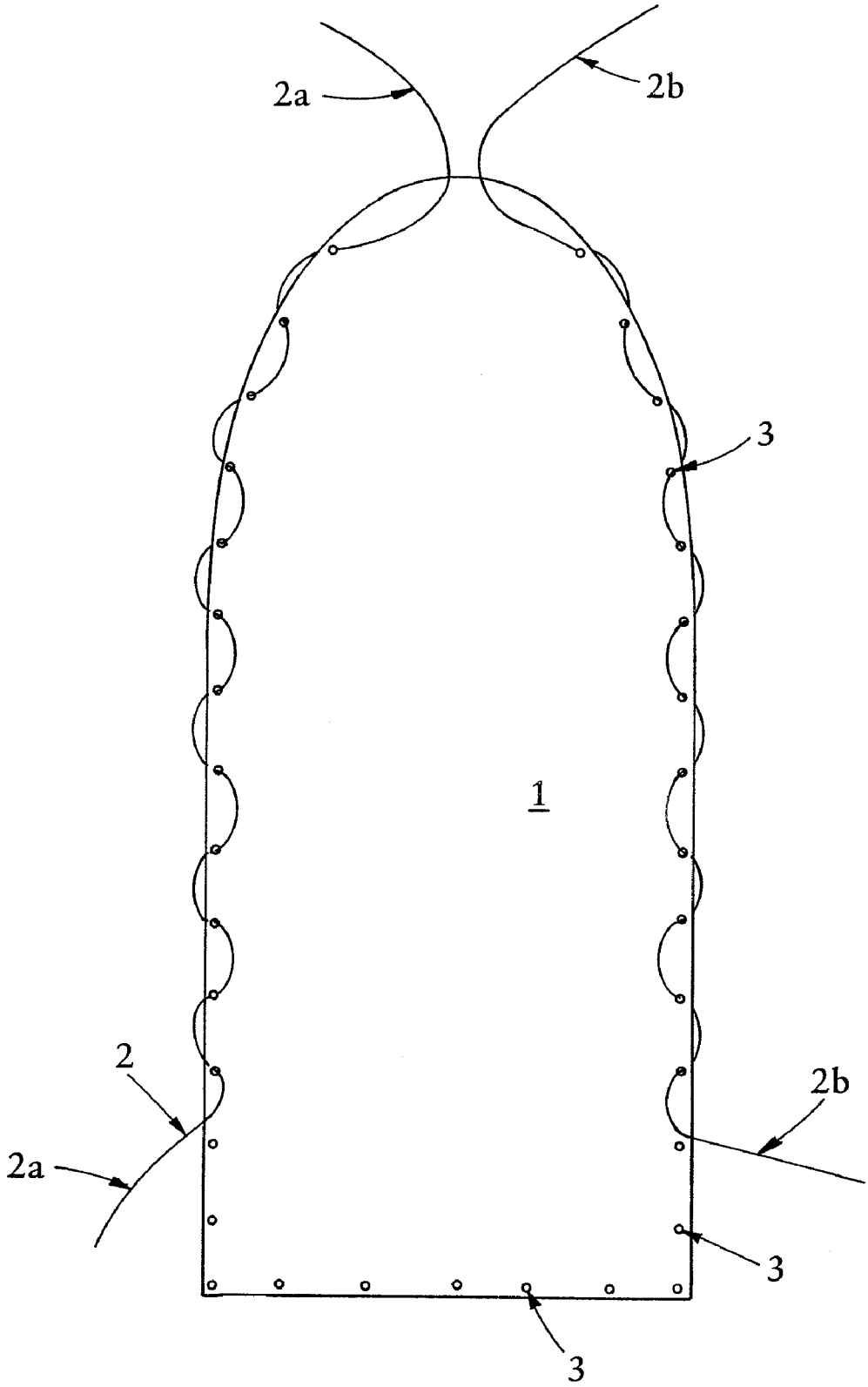
FIG. 1 is a top view of a hull cover according to an embodiment of the present invention in a flat unused position.

FIGS. 1-11 depict embodiments according to the present invention. FIG. 1 depicts a cover 1 useable in an embodiment according to the present invention. In the embodiment of FIG. 1, cover 1 is a substantially rectangular shaped fabric having one end rounded off in a semicircular arc and an opposite end having two right angle corners. It will be understood by persons of skill in the art that cover 1 may be formed or constructed in any number of shapes depending on the vessel hull shape to be covered. In alternate embodiments, cover 1 may be created such that it provides more of a contoured or tailored fit either for the vessel's hull or for other useful purposes. Accordingly, cover 1 is not intended to be limited to the particular shape depicted in FIG. 1 and the description thereof.

In one embodiment, cover 1 is preferably lightweight, flexible and, in a further particular embodiment, slightly negatively buoyant to better facilitate installation and removal of the cover. Cover 1 is preferably waterproof or substantially waterproof or impermeable to water. In alternate embodiments, the buoyancy of cover 1 ranges from buoyant to non-buoyant. Cover 1 is opaque to inhibit light-induced marine life growth on the hull, as well as, to protect the portion of the hull otherwise normally exposed to damaging UV sunlight rays. In another embodiment, cover 1 is constructed of material having properties preventing the growth of fungi and bacterium on the hull cover. In still another embodiment, cover 1 is formed from material which is durable, disrupts galvanic corrosion, and acts as a dielectric to insulate against stray current corrosion. In an alternate embodiment, cover 1 is not opaque and includes the corrosion inhibiting and protecting properties described above.

A first line 2*a* is threaded through a plurality of openings 3 positioned along a left-hand (port) periphery of the cover and a second line 2*b* is threaded through the plurality of openings 3 along a right-hand (starboard) periphery of the cover. In another embodiment, a single line threaded through the plurality of openings 3 replaces lines 2*a* and 2*b*. In an alternate embodiment, openings 3 are evenly spaced around the periphery of cover 1. As described in detail below, lines 2*a* and 2*b* secure cover 1 to a vessel 4 (shown and described with reference to FIG. 2 below).

Figure 2:
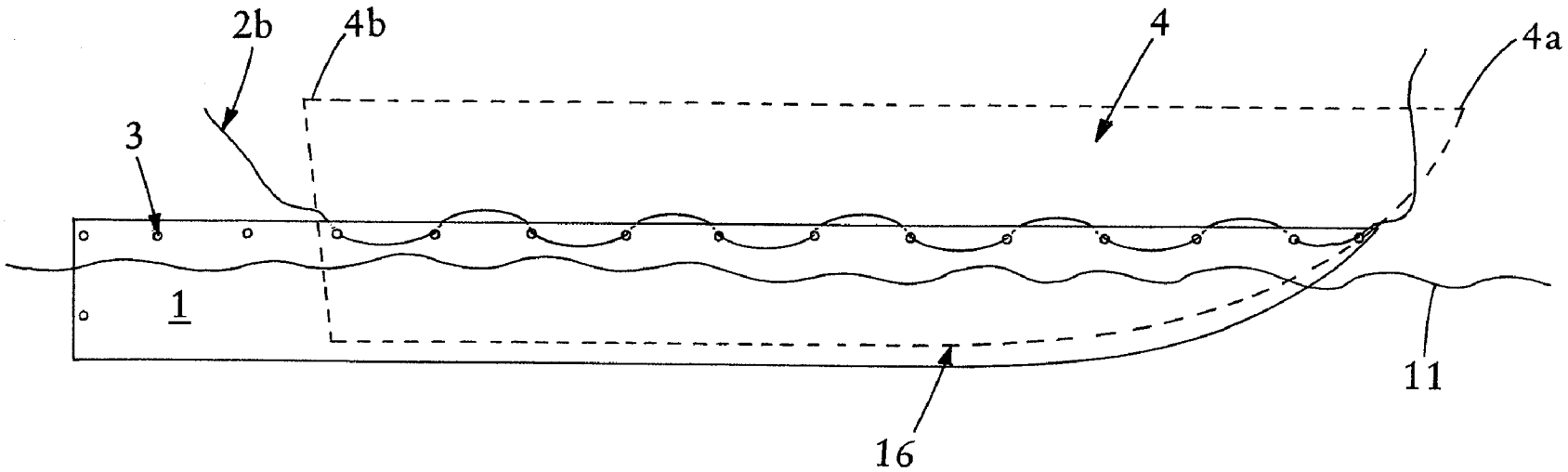
FIG. 2 is a right side view of the hull cover positioned in preparation for operation about the hull of a vessel
Figure 3:
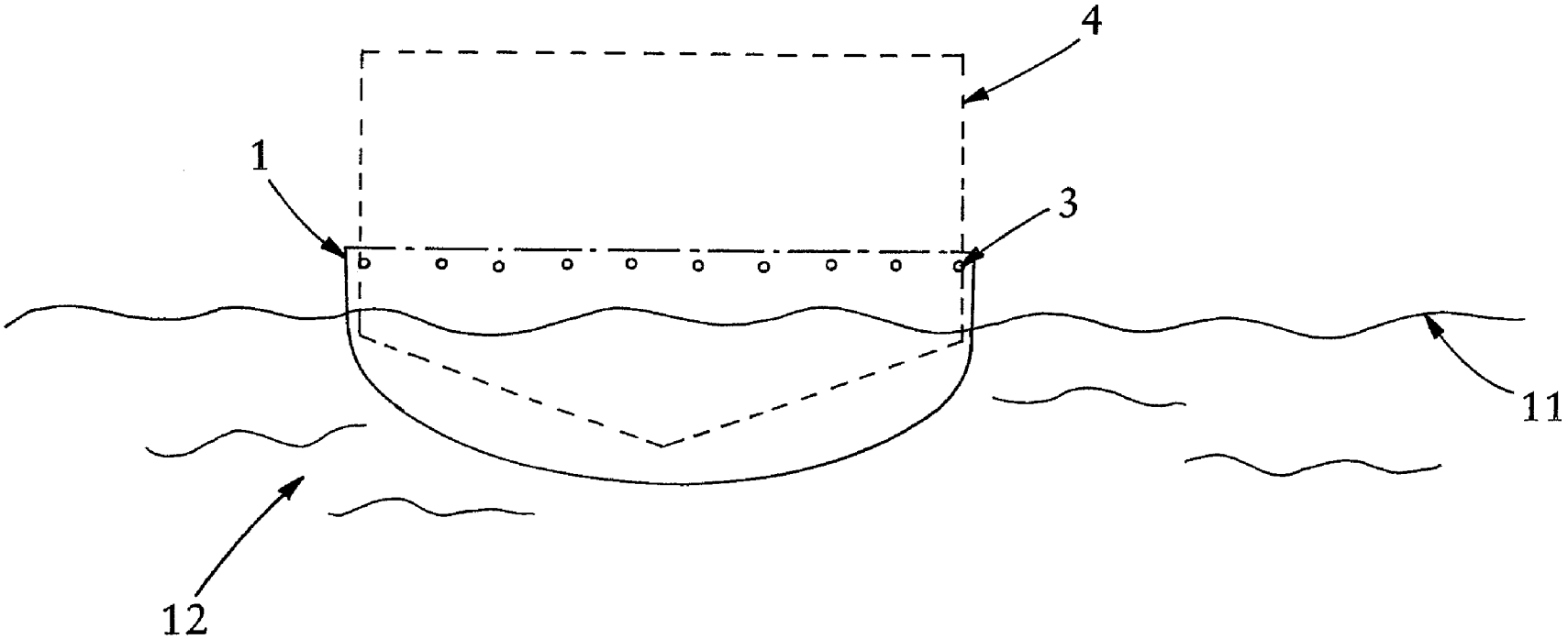
FIG. 3 is a rear view of the hull cover mounted about the hull of the FIG. 2 vessel.

Turning now to FIG. 2, cover 1 covers a portion of the hull of vessel 4, e.g., a boat having a stern-drive propulsion unit, extending in water. Cover 1 extends from bow 4*a* to stern 4*b* and side to side enclosing the portion of the hull extending in water, i.e., the hull portion below waterline 11. In FIG. 2, the end of cover 1 near the stern 4*b* of vessel 4 is not yet closed completely around the vessel. Cover 1 extends from side to side and from below the lowest portion of vessel 4. During installation, the upper edge of cover 1 extends near waterline 11 to a position just above or at the waterline. After installation of cover 1 on vessel 4, all edges of cover 1 are raised above waterline 11 as depicted in FIGS. 4 and 5.

With all edges of cover 1 raised above waterline 11, the cover forms a water impermeable enclosure completely enclosing and preventing water outside the cover from reaching the vessel 4 hull. After the initial positioning of cover 1 around a vessel 4 located in water, cover 1 traps water between the cover and the vessel hull.

Figure 4:
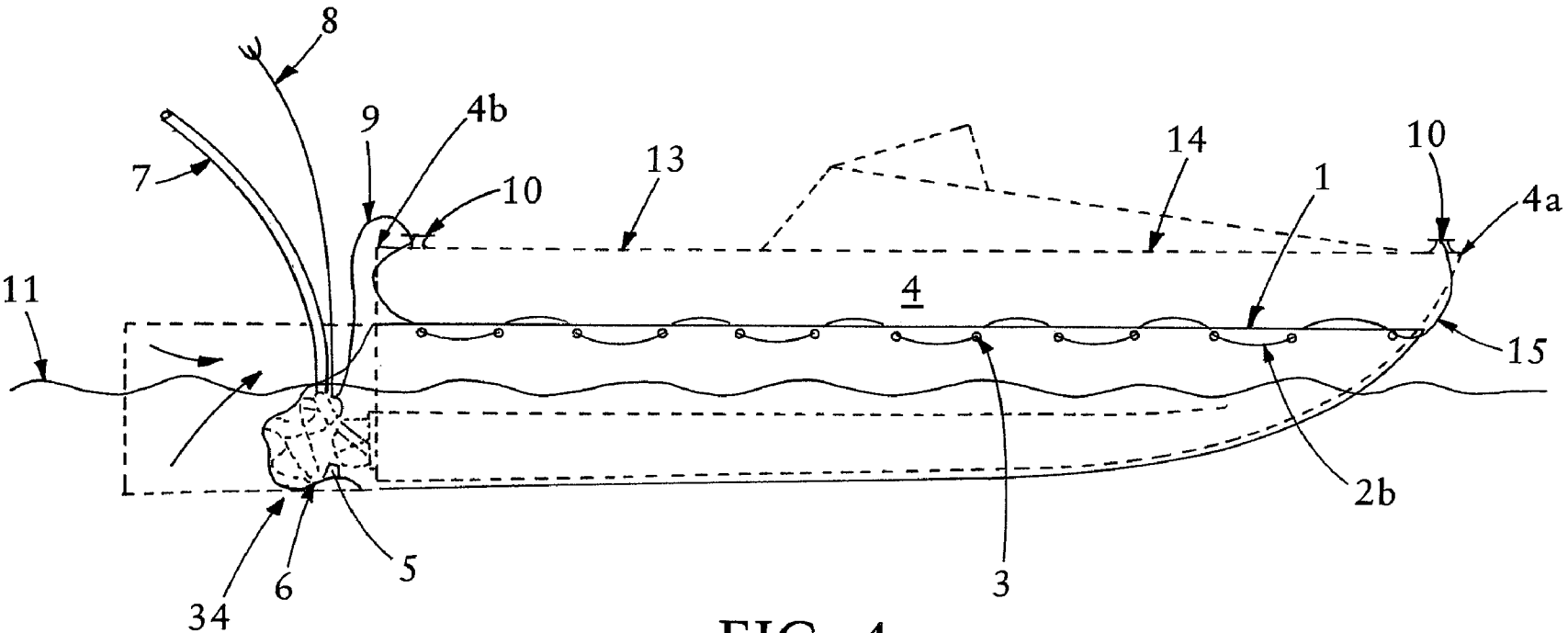
FIG. 4 is a right side view of the FIG. 3 vessel with the hull cover deployed.
Figure 5:
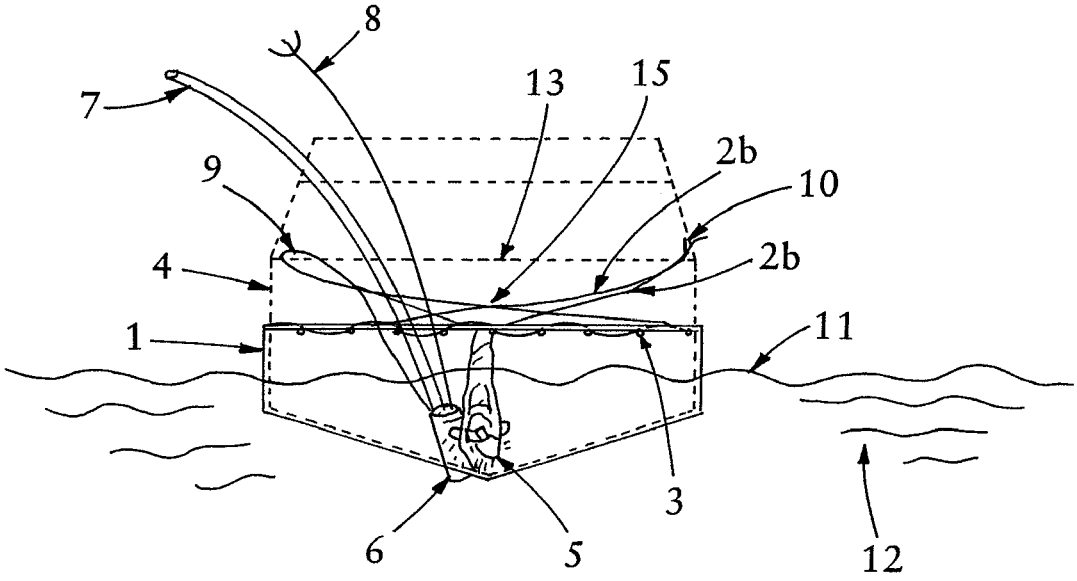
FIG. 5 is a rear view of the FIG. 4 vessel with the hull cover deployed.
Figure 6:
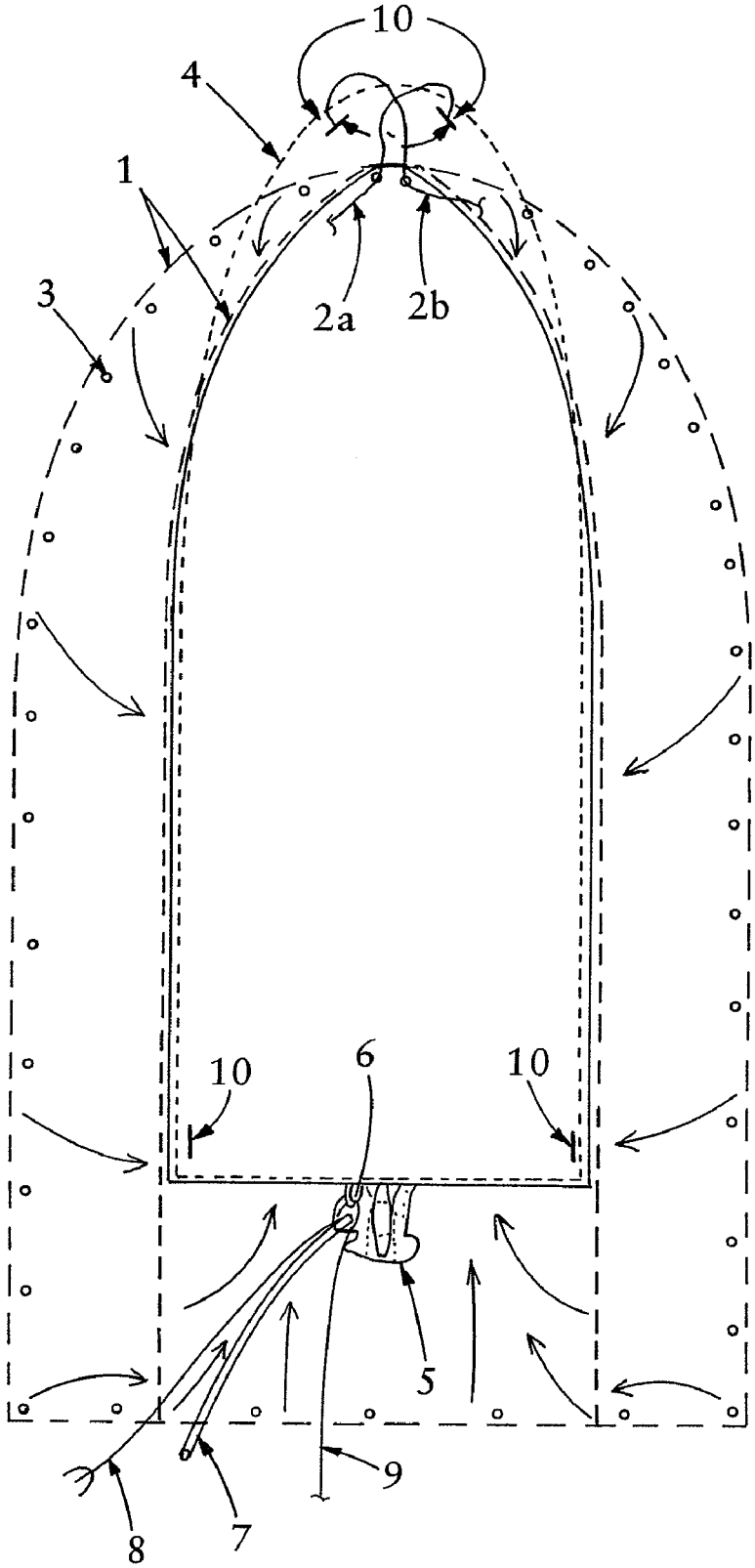
FIG. 6 is a top view of a hull cover according to an embodiment of the present invention deployed on a vessel having a stern-drive (out-drive) propulsion unit.

Reference is now made to FIGS. 4, 5, and 6 wherein vessel 4 includes a propulsion/steering device 5, e.g., a stern drive or other mechanism(s) used to propel and/or steer the vessel 4 in use, attached at one end of vessel 4, e.g., stern 4*b*. In alternate embodiments, vessel 4 includes one or more propulsion devices attached at various positions around vessel 4. In another alternate embodiment, vessel 4 does not include propulsion device 5. Dashed line portion of cover 1 in FIG. 4 depicts the non-enclosed extent of cover 1 prior to positioning around vessel 4. Vessel 4 includes one or more retaining devices 10 positioned along an outer periphery of the vessel, e.g., one or more boat cleats, to which lines 2*a* and 2*b* may be connected to retain cover 1 in position around the vessel. Vessel 4 further includes a top-most portion at a highest outer edge of the hull, e.g., a gunwale or hull side 13, and a deck 14 of a vessel.

As depicted in FIGS. 4, 5, and 6, vessel 4 having cover 1 positioned around the hull of the vessel further includes a fluid evacuating system generally identified by reference numeral 34 for removing water trapped between the cover and the vessel hull. Fluid evacuating system 34 includes a pump 6 positioned within cover 1 and external to vessel 4 and including an inlet for obtaining a liquid, i.e., water, to be removed from within the cover and an outlet for discharging the obtained liquid. A discharge hose 7 connects to an outlet of pump 6 to transport evacuated water away from the enclosure formed by cover 1. A power cord 8 connected to pump 6 provides power to drive pump 6 to pump water out of cover 1. Power cord 8 is connected to a power supply (not shown), e.g., a battery, an electrical power outlet, or other power mechanism.

In one embodiment, pump 6 includes a switching device for automatically activating the pump to remove water detected in cover 1. For example, pump 6 may be a submersible sump-type pump which pumps water when a predetenmined level of water is detected and stops pumping when a second, lower predetermined level of water is detected or has otherwise pumped down the previous quantity of water. In an alternate embodiment, an inlet pipe (not shown) may be attached to the inlet of pump 6 in order to obtain the liquid to be discharged.

In a preferred embodiment of the present invention, pump 6 is a submersible electric pump having an automatic water level sensing switch and is used to dewater and evacuate the enclosure between vessel 4 hull below the waterline within cover 1, e.g., a Flotec IntelliPump. In this particular embodiment, water level sensing switch is integral with the pump; however, in alternate embodiments the switch may be an external mechanism or the switch may be manually actuated. In alternate embodiments, pump 6 is powered either by alternating current (AC) power, direct current (DC) power, or both. In particular embodiments, pump 6 is connected to an electrical outlet either onboard vessel 4, to a power supply provided external to vessel 4, e.g., dock-supplied power, to a DC battery cell on board vessel 4, or other means of supplying power to pump 6, e.g., rectifiers, fuel cells, windmills, solar cells mounted on board the vessel or on the dock, etc.

A tie-off line 9 secures pump 6 to vessel 4 in order to prevent accidental loss of pump 6. Tie-off line 9 is not critical to operation of embodiments according to the present invention and may be omitted with no impact on the functionality of the present invention.

In use, pump 6 pumps, via discharge hose 7, the trapped water out of the enclosure created by cover 1 surrounding vessel 4 and thereby evacuates the space between the vessel 4 hull and the interior of cover 1. Evacuation of water from between the vessel 4 hull and cover 1 establishes preferred conditions for laying up vessel propulsion device 5 exposed through the vessel 4 hull, e.g., through a transom or other steering mechanism, as well as the hull and other appendages extending below waterline 11 and exterior to the vessel 4 hull.

As depicted in FIGS. 4, 5, and 6, lines 2*a* and 2*b* pass through openings 3 in order to support cover 1 in position enclosing the vessel 4 hull. In one embodiment, openings 3 include grommets for strengthening the openings to resist tearing and withstand concentrated straining points during use. Lines 2*a* and 2*b* connect to one or more retaining devices 10 on vessel 4 such that the lines may be drawn up tight and retain cover 1 positioned about the vessel.

Further, as depicted in the embodiment of FIG. 4, cover 1 fits at the bow 4*a* above waterline 11 but below the top-most portion 14. In this embodiment, adequate protection in relatively peaceful mooring conditions while minimizing wasted material is obtained. Cover 1 dimensions vary for a given vessel and to suit the needs of a particular mooring environment. At a minimum, cover 1 includes an amount of material sufficient to raise all edges of the cover above waterline 11 and allow for deployment such that water splashing above the edge of the cover and into the evacuated enclosure due to occasional wave action or vessel motion while moored is minimized.

In FIGS. 4, 5, and 6 depicting an example of cover 1 constructed and positioned on a particular vessel 4, the cover has been fit to the vessel fore and aft such that lines 2*a* and 2*b* are tied on either side of the vessel and wrap under the bow crossing approximately at the vessel's centerline at a point 15 in FIGS. 4 and 5 located at a vertical height above openings 3 at bow end 4*a*, but below the retaining devices 10 to which the rigging lines 2*a* and 2*b* attach at the bow. Crossing lines 2*a* and 2*b* as described is not mandatory but reduces stress points in cover 1 where the line passes through the first openings 3 on bow end 4*a*. Alternatively, lines 2*a* and 2*b* may be tied off on bow 4*a* on the same side of vessel 4 to which they run fore and aft.

With rigging lines 2*a* and 2*b* crossed at bow 4*a*, the lines thread through the successive openings 3 in a single pass, as shown in FIGS. 1, 2, and 4, fore and aft in a preferred embodiment of the present invention. At the rear of cover 1, rigging lines 2*a* and 2*b* exit the last opening 3 in the cover lying at or before the aft corner edge of the vessel 4 hull forming the aft side corner of the transom meeting either of the vessel's sides.

In a preferred embodiment of the present invention, a single rigging line 2 (in place of lines 2*a* and 2*b* as described above) exiting the last opening 3 of the aft portion of cover 1 may then be drawn around the corner formed by the vessel's right or left side with the transom and secured to a retaining device 10 located near the stern 4*b* on the opposite side of the vessel as depicted clearly in FIG. 5. According to this embodiment, the lines cross at stern 4*b* in the same fashion as at bow 4*a* for the same reasons as described above for the bow crossing of lines. Alternatively, the lines at stern 4*b* may not cross but remain wrapped about the stern corners of vessel 4 formed by the vessel's sides with the transom. In a further alternate embodiment, the lines 2*a* and 2*b* do not wrap around the rear corners of vessel 4 but are fastened to retaining devices 10 on a respective side of the vessel.

Figure 7:
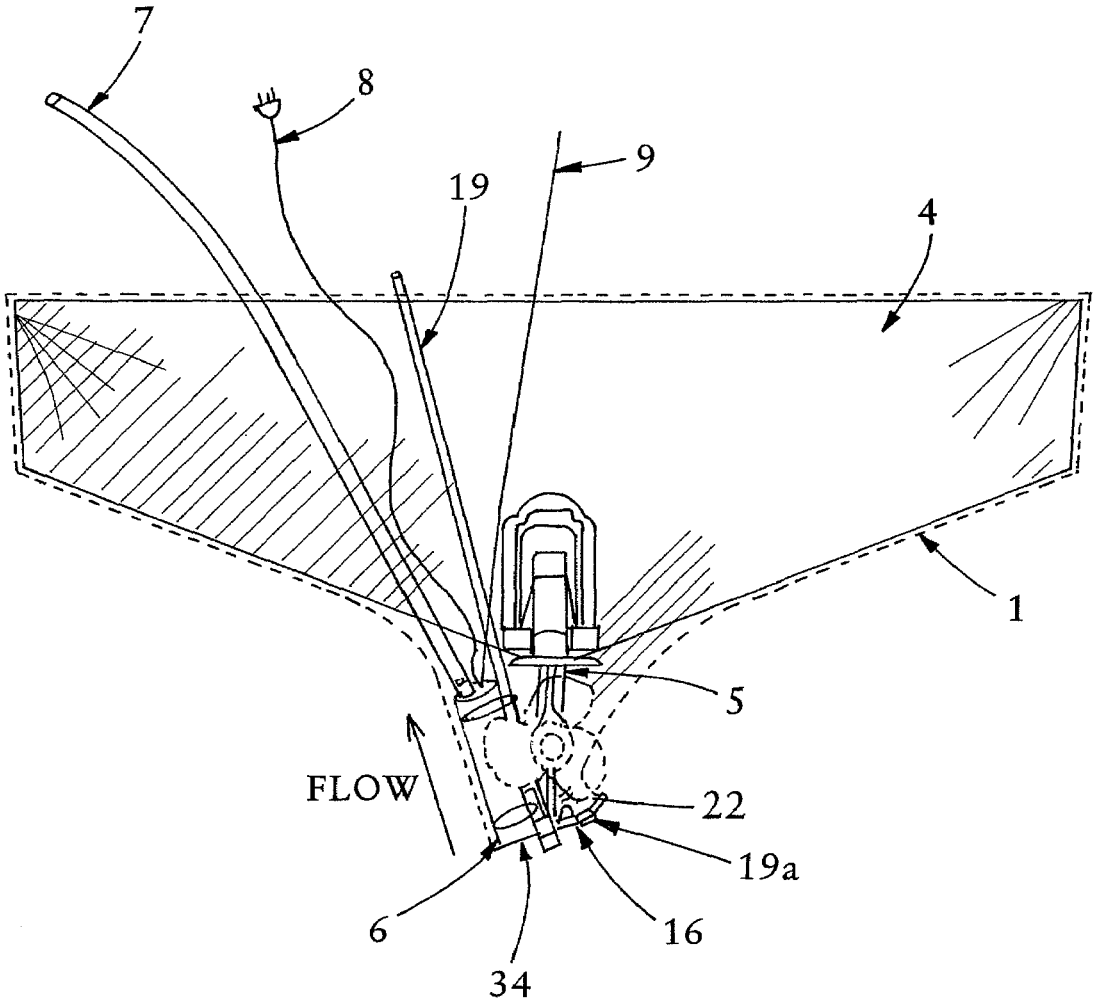
FIG. 7 is a close up rear view of the FIG. 6 vessel with a stern drive propulsion unit.

FIG. 7 depicts a rear view of fluid evacuation system 34 including submersible pump 6 positioned adjacent propulsion device 5 and within cover 1 and connected to a positioning member 19 at a lower end thereof. Positioning member 19 facilitates positioning of pump 6 with respect to propulsion device 5 and bottom of cover 1. In one embodiment, positioning member 19 is a telescoping tube enabling pump 6 to be placed at an appropriate depth with respect to propulsion device 5.

According to the FIG. 7 embodiment, fluid evacuation system 34 further includes a positioning member hook 19*a* connected with positioning member 19 and forming a substantially right angle with respect to the length of the positioning member. Positioning member hook 19*a* catches the lowest part of propulsion device 5, such that pump 6 intake is positioned to form an effective sump within cover 1. In one particular embodiment, positioning member hook 19*a* underlies the bottom of propulsion device 5 and tie-off line 9 applies upward tension on pump 6 in order to secure and operate the pump in position while removing water from within cover 1.

As described above power cord 8 provides power to pump 6. As pump 6 transports water out of cover 1, the flexible material of the cover begins to close about the contour of vessel 4 hull and appendages, as applicable. Water pressure outside of cover 1 presses the cover to the vessel with pump 6 forming the lowest point beneath vessel 4 and creating a sump area to which water drains due to gravity. Pump 6 discharges water from within the enclosure through discharge hose 7 and if the water level within cover 1 reaches a predetermined level, i.e., a low level of water indicating evacuation of a sufficient amount of water that vessel 4 hull is no longer contacting water, the pump shuts off.

Figure 8:
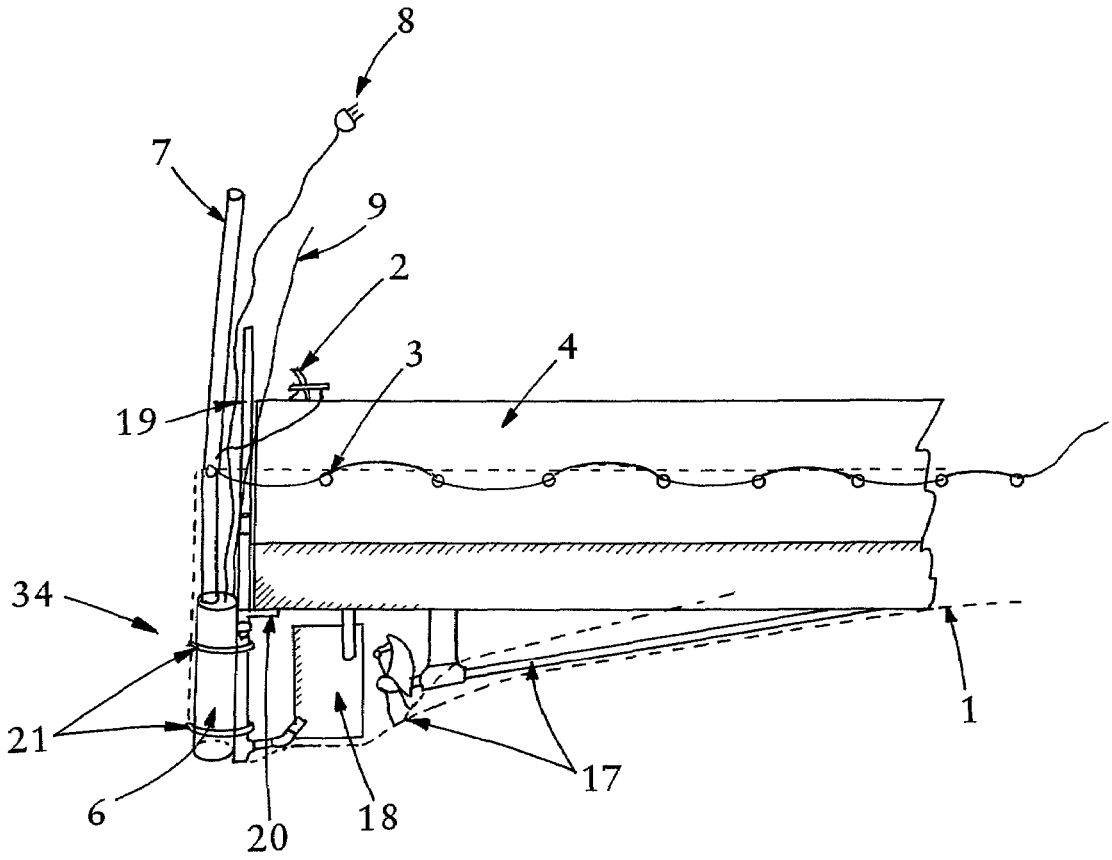
FIG. 8 is a side view of the rear portion of a vessel having an inboard propulsion system.

Various embodiments according to the present invention accommodate vessels with features below waterline 11 other than the above-described propulsion device 5. One such variation is an alternative mechanism for creating the sump within cover 1 used on vessels having an inboard drive system as depicted in FIG. 8. On such vessels, deploying cover 1 and creating the sump drain point for pump 6 is facilitated by catching the positioning member stanchion bracket 20 on an extremity below the water line, e.g., the keel 16. In contrast, trying to use the positioning member hook 19*a* to otherwise catch a propeller or rudder may be inconvenient for a person standing on the vessel or a dock. In these circumstances an appropriate extremity may be located too far forward of the stern 4*b* to allow for maneuvering pump 6 into position using positioning member hook 19*a*, or there may be a swim or dive platform as an impediment to creating the sump feature within cover 1 with positioning member 19 positioned from the vessel's stern. In such circumstances, positioning member 19 uses positioning member stanchion bracket 20 and is positioned alongside vessel 4 to create the required drain point.

In FIG. 8, pump 6 is attached to positioning member 19, e.g., a telescoping pump stanchion, which is adjusted to a given length and lowered off vessel 4. Positioning member 19 is maneuvered into place with respect to vessel 4 at a point low enough beneath the vessel to create a sump within cover 1. Positioning member 19 is secured to the stern 4*b* of vessel 4, e.g., using ropes or other securing means. With pump 6 and positioning member 19 positioned, cover 1 may be fit underneath both vessel 4 and evacuating system 34, including pump 6 and positioning member 19, and positioned about stern 4*b* of the vessel and secured as described above using lines 2*a* and 2*b*. With cover 1 and evacuation system 34 positioned, the enclosure formed between cover 1 and vessel 4 is evacuated, i.e., dewatered, which removes the majority of water and contour fits the cover about the vessel hull, propulsion device 5, and any other components beneath waterline 11. Water within cover 1 drains to the lowest point within the cover and is pumped out by pump 6. In an alternate embodiment, cover 1 is positioned first and evacuating system 13 is positioned second within the cover.

Figure 9:
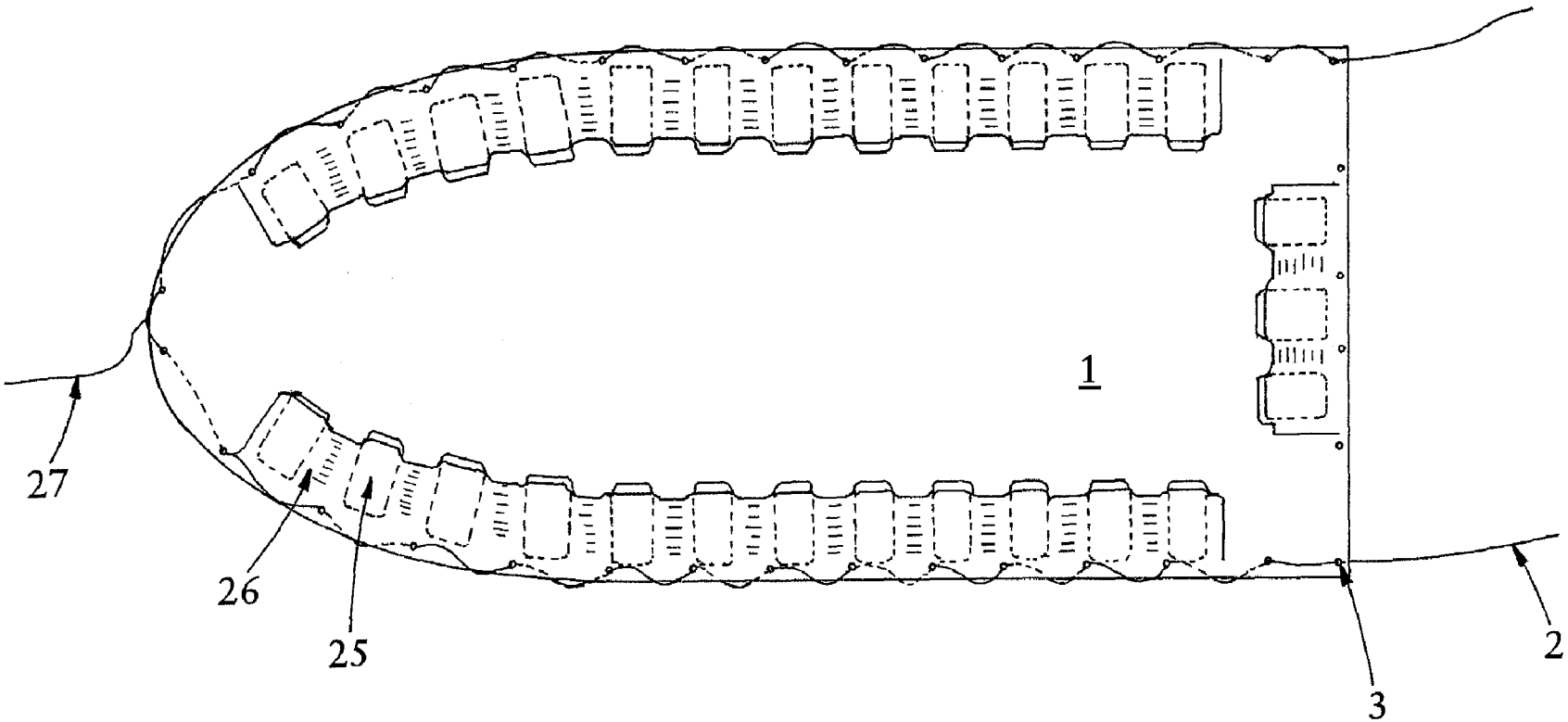
FIG. 9 is a top view of a hull cover according to an embodiment of the present invention employing buoyant battens.
Figure 10:
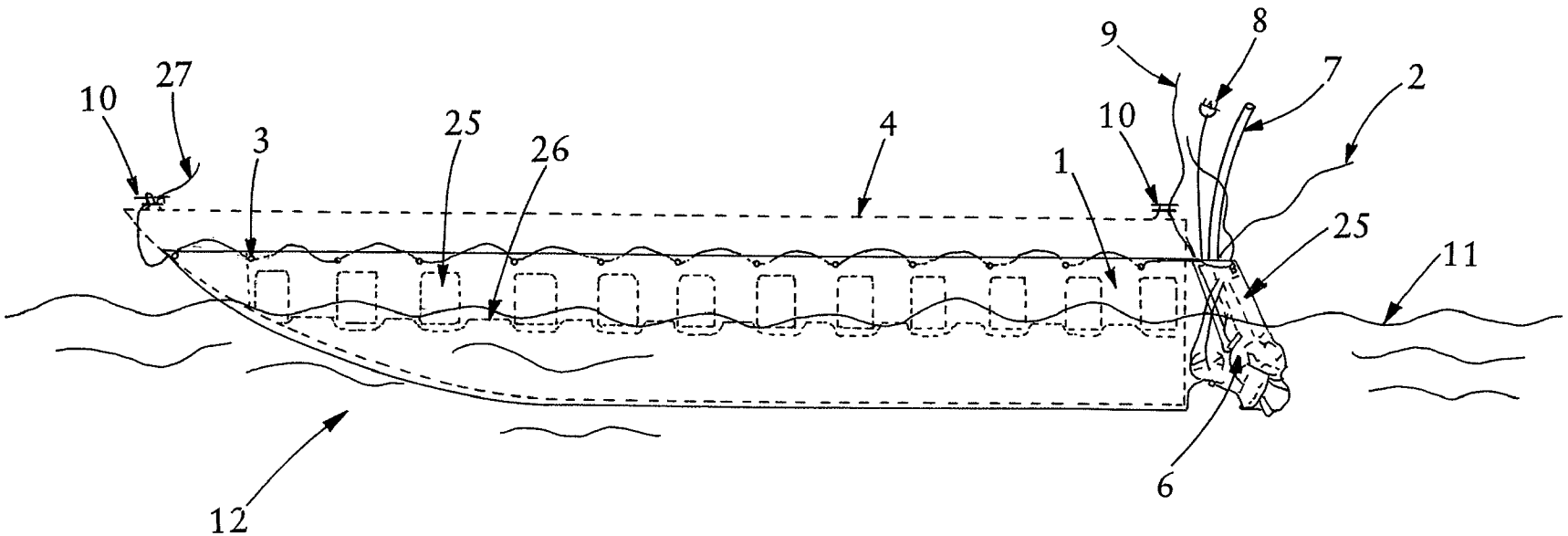
FIG. 10 is a left side view of an embodiment according to the present invention using the buoyant battens of FIG. 9 deployed on a floating vessel.

FIGS. 9 and 10 depict buoyant battens 25 spaced within a series of inverted pockets 26 provided about the periphery of cover 1. The buoyant battens 25 are constructed from any suitable material providing buoyancy, e.g., inflated or non-inflated battens. A positioning lanyard 27 depicted in FIGS. 9 and 10 is connected to one end of cover 1 and tied off about the vessel's bow 4*a* and helps keep the cover and battens 25 in position as the cover is deployed and drawn beneath vessel 4, and then tied up with a cinching action of lines 2*a* and 2*b*, which are joined together in this case to create a cinching belt 2. The lines 2*a* and 2*b* cinch the edge of cover 1 above battens 25 and tend to keep the cover edge out of the water prior to evacuation of water from between cover 1 and vessel 4. Positioning lanyard 27 assists at the start of the cinching procedure by keeping cover 1 front end from sliding beneath vessel bow 4*a* as the slack material in the cover is pulled aft.

Figure 11:
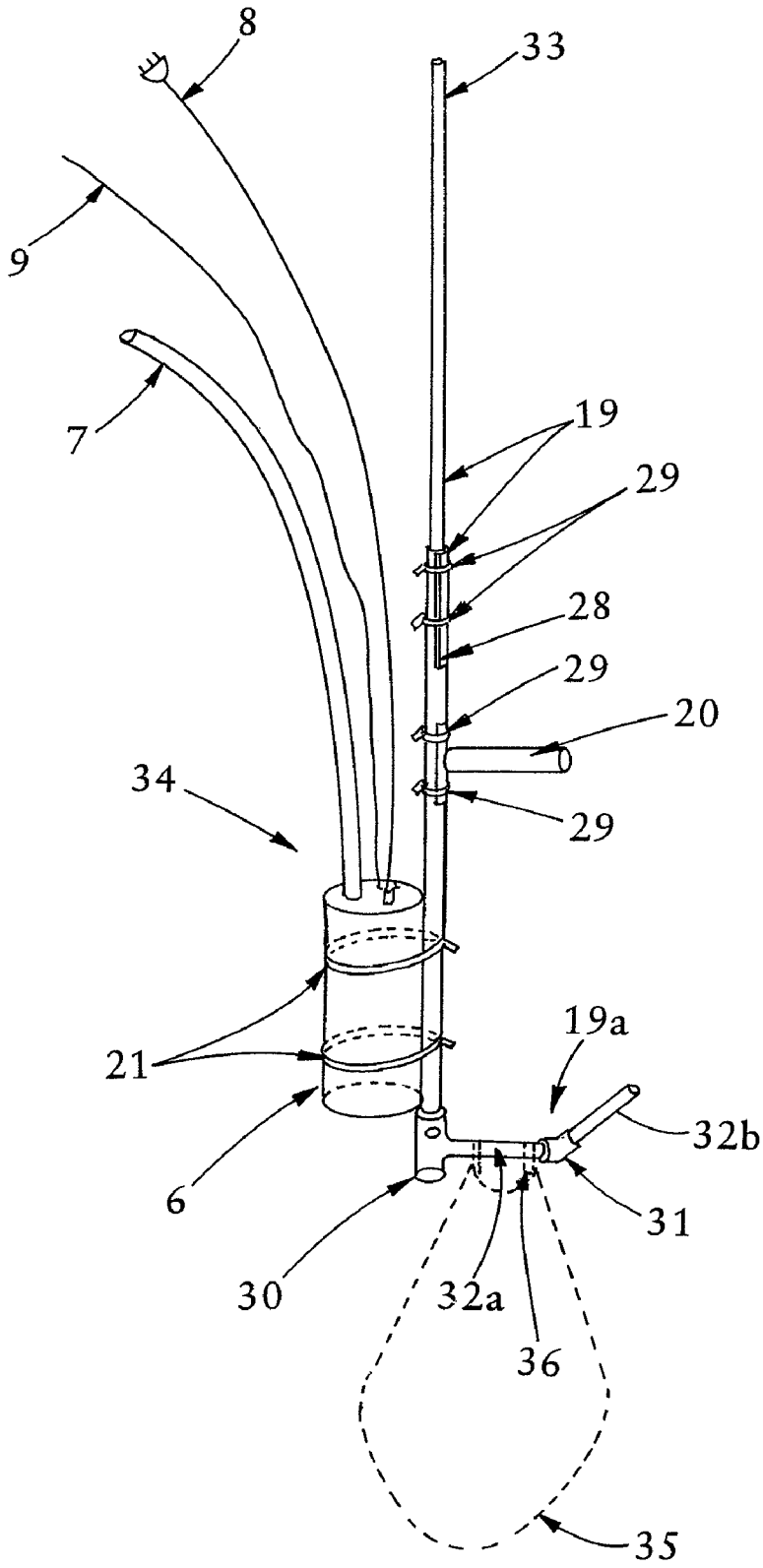
FIG. 11 is a detailed view of a hollow positioning device useable in conjunction with an embodiment according to the present invention using a submersible pump as a fluid evacuating device.

FIG. 11 depicts a side view of positioning member 19 as part of fluid evacuating system 34. Positioning member 19 may be any suitable material providing sufficient strength for bracing pump 6 and maintaining a sump recess in cover 1 after the cover becomes buoyant as water is evacuated from the interior. In one embodiment, positioning member 19 is hollow and air tight in order to withstand and support stresses related to evacuating water from within cover 1. In an alternate embodiment, positioning member 19 may be used in conjunction with an external pump for evacuating water from the interior of cover 1. In addition, according to a preferred embodiment, positioning member 19 material is preferably impervious to corrosion when exposed to water and does not present a hazard or cause deleterious effects when making contact with a variety of common vessel hull construction materials such as fiberglass, wood, steel, aluminum, fabric, etc.

FIG. 11 depicts the evacuating system 34 including positioning member 19 and positioning member hook 19*a* constructed from, for example, PVC schedule 40 tubing and addressing the aforementioned stress requirements. Evacuating system 34 may be constructed in any size needed depending on the depth of vessel 4 and extent of external fixtures. In the FIG. 11 example, two 3 foot (3') sections of tubing make up the positioning member 19 in a telescoping fashion where a smaller diameter section, e.g., one inch diameter, fits within a larger diameter section, e.g., 1.25 inch diameter. The smaller diameter section is able to slide within the larger diameter section.

In alternate embodiments, positioning member 19 is made up of one or more segments. In a multiple segment embodiment, positioning member 19 is able to telescope to different lengths.

The larger diameter section is split from a tube end lengthwise along the section with two separate cuts 28 approximately 5 inches in length and approximately 0.125 to 0.25 inches in width for each cut. The twin cuts on the larger diameter section of positioning member 19 interior edge allow for two clamps 29, e.g., stainless steel hose clamps, to constrict the larger diameter tube about the smaller diameter tube and provide for flexibly creating a positioning member of a desired length. Alternate embodiments for connecting the pieces of positioning member 19 are contemplated.

The larger diameter section is at the bottom of positioning member 19 and is fitted with a tee fitting 30 at a lower end thereof. The end of tee fitting 30 forming the bottom of positioning member 19 is open to allow passage of water through the member. The tee fitting 30 includes an opening perpendicular to positioning member 19 and fitted with a 3 inch (3") section of tubing 32*a* joined to an angled elbow fitting 31, e.g., a 45 degree angle elbow. The distal end of elbow fitting 31 connects to a 6 inch (6") section of tubing 32*b* open on the distal end from elbow 31. The attitude of elbow 31 is upward and in line with the vertical axis of the longer sections of positioning member 19. Elbow 31 and tubing sections 32*a*, 32*b* form the positioning member hook 19*a*, able to catch on vessel 4 extremities, e.g., a propeller, outdrive skeg, or even the hull itself. Hook 19*a* may be used to either hold positioning member 19 and evacuating system 34 in place alone or in combination with pump 6 directly mounted to hook 19*a*.

In the embodiment employing a submersible pump as pump 6, the pump is attached to positioning member 19 using two clamps 21, e.g., stainless steel hose clamps, at a position above tee fitting 30.

Figure 13:
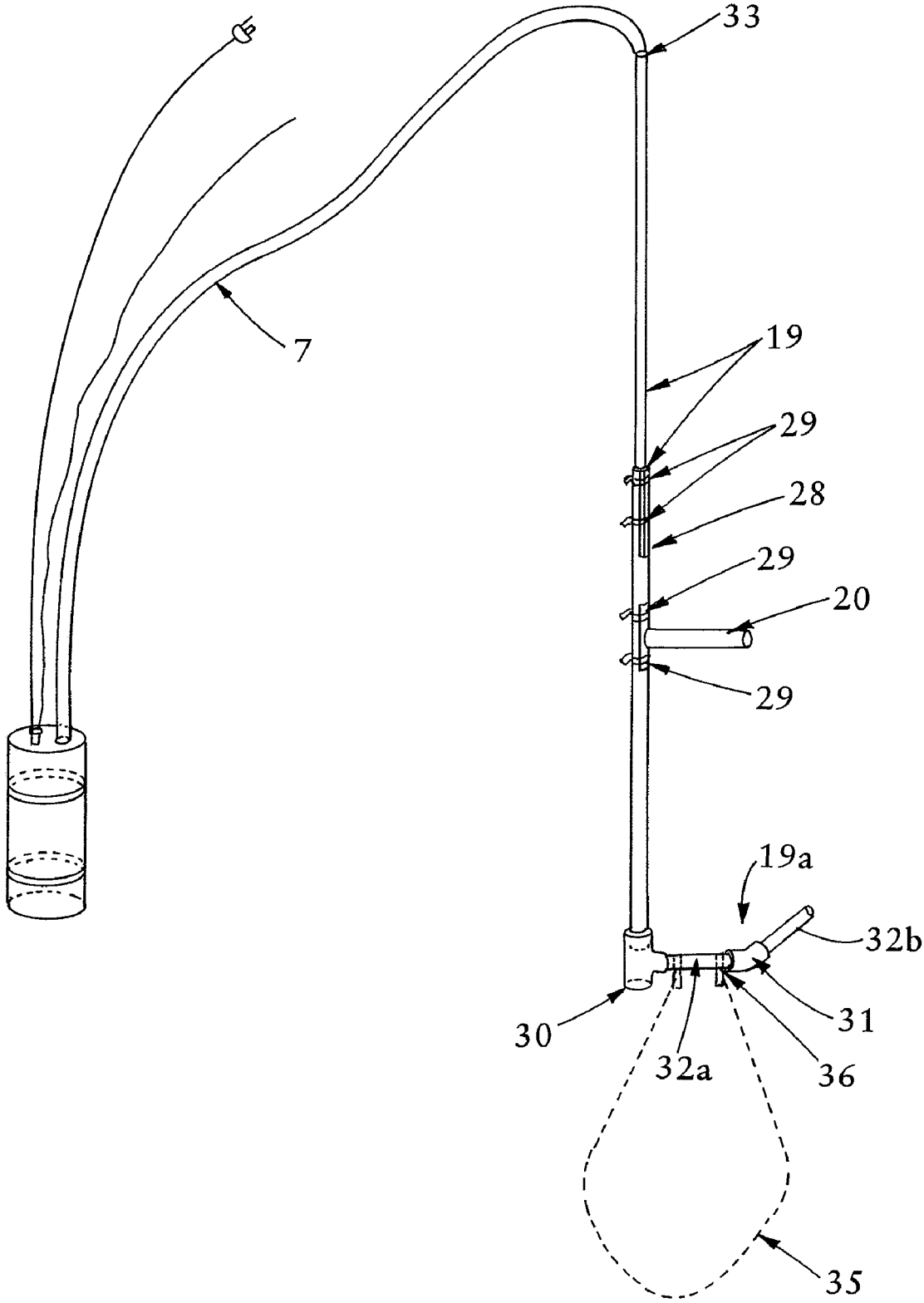
FIG. 13 is a functional diagram of another embodiment of a hollow positioning device connected to a pump.

In an embodiment, e.g., as depicted in FIG. 13, using an external pump as pump 6, a hose from the pump is connected, e.g., using clamps, to open end of tubing 33, i.e., distal from angled elbow fitting 31. Initially, water is drawn from the lower part of tee 30 along with water falling through the open end of a tubing 32*b* whose opening is modestly higher up as part of hook 19*a*. Water is removed until the water level within the cover reaches a predetermined level. Additionally, positioning member 19 may be fitted with a positioning member stanchion bracket 20 connected to the positioning member but higher up above pump 6 and Suction end of the positioning member, i.e., connection with tee fitting 30. Positioning member stanchion bracket 20 is made of the same material as positioning member 19 and provides a bracing area approximately 9 inches in length and perpendicular to the positioning member. Positioning member stanchion bracket 20 may be positioned using a pair of clamps 29, similar to clamps 21, connected to positioning member 19.

In an alternate embodiment (not shown), positioning member 19 is hollow and an external pump 6 is connected via a hose, e.g., discharge hose 7 now acting as a suction hose for an externally mounted pump, to an upper end 33 of positioning member 19 in order to remove fluid from between vessel 4 and cover 1 surrounding the vessel. Pump 6 draws fluid along the length of hollow positioning member 19 via discharge hose 7.

Specific additional alternatives according to the present invention are now described.

The flexible hull cover is portable and maybe deployed in either of two ways. In one embodiment of the invention, the hull cover's material at its peripheral edge above the water line is suspended from and affixed only to the vessel to which it is attached. The edge of the material is suspended by lines that run fore and aft on the port and starboard sides, which themselves are tied off or otherwise made fast to cleats or fittings present in these fore and aft locations of the vessel topside. The cover's edge is held up by this rigging above the waterline sufficiently to prevent typical wave action from breaching the upper edge of the cover that would allow water to enter back within the cover. The lines are not required for supporting the cover or keeping it in place once deployed as designed, only to prevent it from foundering once the material is pumped out and deployed. A pump removes the water from within the material. The buoyancy created by removing the water from within the enclosure is what supports the cover and keeps it in place about the vessel once deployed.

Another embodiment of the invention does not use any rigging lines to suspend the upper peripheral edges of the hull cover in place about the vessel. Instead the peripheral edge of the hull cover is cinched about the vessel by a line that threads through the grommets in the cover. The line fastens to itself as if it were being used as a belt about the periphery of the vessel at a distance above the waterline. In this embodiment, the material of the hull cover beneath the belt needs to rise above the waterline to prevent wave action from splashing water over the edge and into the enclosure is held up by integral buoyant battens which are spaced apart from one another and held within or attached to the material in the vicinity of its edges. The battens in conjunction with the cinching action of the belt serve to stiffen the cover's raised edge sufficiently such that with the upper most edge of the hull cover being cinched and the lower material at the waterline and below being pressed Lip against the vessel's hull once the hull cover is dewatered, the battens keep the edge of the hull cover material raised above the waterline and form an adequate barrier preventing waves from splashing over top of the material and reentering the cover.

In an alternate embodiment, battens 25 may be separate from cover 1 and attachable via attaching means, e.g., hook and eye fasteners, buttons, zippers, etc., to the cover periphery for retaining the cover in position around the vessel 4.

Another embodiment of the present invention is portable such that the device may be removed from a deployed position beneath a vessel and stowed on the vessel if desired.

Another embodiment of the present invention shown in FIG. 11 includes a positioning member hook skirt 35 (dashed lines) deployed with the positioning member 19 to help protect the hull cover 1 from being abraded or ruptured accidentally by any exterior vessel appendages in the vicinity where the positioning member book 19*a* contacts the vessel, e.g. at the vessel's outdrive. Positioning member hook skirt 35 is made of a durable material, e.g., Dupont Cordura, and protects cover 1 material from sharp edges that may be present at the point of contact between the vessel and the cover. In one embodiment, positioning member hook skirt 35 is retained in place by rings 36 connected to the positioning member hook assembly 19*a* tubing section 32*a* and attached to the skirt 35. A line (not shown) can be tied to the end of the skirt 35 distal from the edge affixed to the rings such that the operator is able to pull the skirt in place up and around a vessel appendage, such as an outdrive, after the positioning member hook 19*a* has been set. The skirt remains between the vessel's appendage and the hull cover when fully deployed.

After reading the foregoing specification, one of ordinary skill will be able to affect various changes, substitutions of equivalents and various other aspects of the invention as broadly disclosed herein. It is therefore intended that the protection granted hereon be limited only by the definition contained in the appended claims and equivalents thereof.

Figure 12:
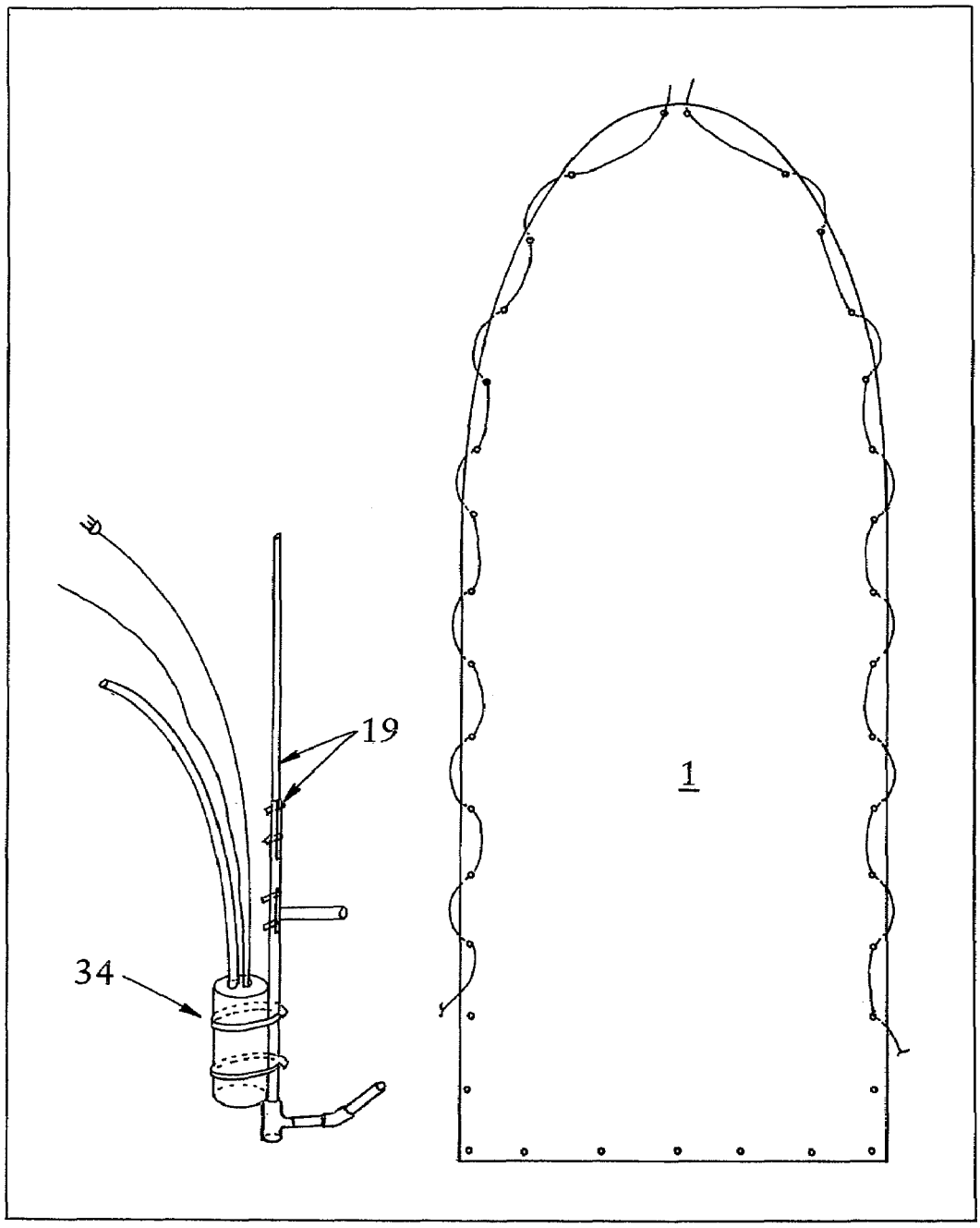
FIG. 12 is a functional diagram of a kit according to an embodiment of the present invention.

A kit embodiment, e.g., as depicted in FIG. 12, for a vessel enclosure comprises a container, and a vessel hull protecting device positioned within the container. The vessel hull protecting device comprises a cover positioned surrounding a vessel in a fluid and attached solely to the vessel and a pump positioned between the cover and the vessel for removing fluid from between the cover and the vessel. The cover encloses the vessel portion extending in the fluid. The pump is accessible without removing the cover from the vessel. In a further embodiment, the container is a bag. In a further still embodiment, the kit further comprises a positioning member attachable to a vessel. In at least one embodiment, the positioning member has an attachment point for a pump.

I claim:

1. A vessel hull protecting device comprising:

a cover positioned surrounding a vessel in a fluid and attached solely to the vessel, wherein the cover encloses the vessel portion extending in the fluid;

a pump positioned between the cover and the vessel for removing fluid from between the cover and the vessel, wherein the pump is accessible without removing the cover from the vessel; and a positioning member, positioned between the cover and the vessel, operatively connected to the pump for positioning the pump relative to the vessel and within the cover, wherein the positioning member length is adjustable.

2. The device of claim 1, wherein the cover is substantially fluid-proof.

3. The device of claim 1, wherein the cover is fluid-proof.

4. The device of claim 1, wherein the cover shape corresponds to a shape of the vessel hull.

5. The device of claim 4, wherein the cover is rectangular-shaped.

6. The device of claim 1, further comprising a positioning member attaching the pump to the vessel.

7. The device of claim 6, wherein the positioning member length is adjustable.

8. The device of claim 1, wherein the cover is form-fit to the vessel hull.

9. The device of claim 1, wherein the cover is negatively buoyant.

10. The device of claim 1, wherein the cover is positively buoyant.

11. The device of claim 1, wherein the cover is neutrally buoyant.

12. The device of claim 1, wherein the cover inhibits marine growth on the vessel.

13. The device of claim 1, wherein the cover acts as a dielectric insulator.

14. The device of claim 1, wherein the cover includes a plurality of openings along a periphery of the cover for receiving a line therethrough for retaining the cover in position with respect to the vessel.

15. The device of claim 1, the cover further comprising:

a plurality of inverted pockets along a periphery of the cover, and;

a plurality of buoyant battens, each batten insertable in one of the inverted pockets for positioning the cover with respect to the vessel.

16. The device of claim 1, the cover further comprising:

a plurality of buoyant battens, each batten attachable to a location along a periphery of the cover for positioning the cover with respect to the vessel.

17. The device of claim 1, the cover further comprising:

a positioning line connected to one end of the cover for retaining the cover in position with respect to the vessel.

18. The device of claim 1, the positioning member further comprising:

a first member positioned substantially vertical and having a first end above the fluid, and;

a second member operatively connected to a second end of the first member away from the first end.

19. The device of claim 18, wherein the first member and second member are slidably connected to each other.

20. The device of claim 18, further comprising:

a third member operatively connected to an end of the second member distal from the first member, the third member extending from the second member.

21. The device of claim 20, the third member positionable at a lowest point of the vessel in the fluid.

22. The device of claim 20, further comprising:

a fourth member operatively connected to the second member at a position above the third member connection to the second member and below the first member, the fourth member extending from the second member.

23. The device of claim 1, further comprising:

a hose connected at a first end to the pump for transporting fluid removed from between the cover and vessel.

24. The device of claim 23, wherein a second end of the hose is positioned external to the cover.

25. A vessel hull protecting device comprising:

a cover positioned surrounding a vessel in a fluid and attached solely to the vessel, wherein the cover encloses the vessel portion extending in the fluid and is at least substantially waterproof;

a pump positioned external to the cover for transporting fluid from between the cover and the vessel;

a hollow positioning member having a first open end and a second open end, the first open end extending between the vessel and the cover enclosing the vessel portion extending in the fluid, the second open end extending above the fluid level external to the cover, wherein the hollow positioning member length is adjustable;

and a hose having a first open end and a second open end, the first open end attachable to the hollow positioning member, the second open end of the hose attachable to the pump.

26. The device of claim 25, wherein the cover includes a plurality of openings along a periphery of the cover for receiving a line therethrough for retaining the cover in position with respect to the vessel.

27. The device of claim 25, the cover further comprising:

a plurality of inverted pockets along a periphery of the cover, and; a plurality of buoyant battens, each batten insertable in one of the inverted pockets for positioning the cover with respect to the vessel.

28. The device of claim 25, the cover further comprising:

a plurality of buoyant battens, each batten attachable to a location along a periphery of the cover for positioning the cover with respect to the vessel.

29. The device of claim 25, the cover further comprising:

a positioning line connected to one end of the cover for retaining the cover in position with respect to the vessel.

30. The device of claim 25, wherein the first open end of the hollow positioning member forms a hook positionable below a lowest point of the vessel in the fluid.

31. The device of claim 25, the hollow positioning member further comprising:

a lower hollow member having a first open end and a second open end, the first open end operatively connected to the hollow positioning member between the first and second open ends of the hollow positioning member, the lower hollow member extending from the hollow positioning member, and;

wherein the first open end of the hose attachable to the second open end of the hollow member for receiving fluid from the lower hollow positioning member.

32. The device of claim 31, wherein the lower hollow member is positioned at a lowest point of the vessel in the fluid.

33. The device of claim 31, wherein the lower hollow member is positioned below a lowest point of the vessel in the fluid.

34. The device of claim 31, wherein the lower hollow member forms a hook positionable below a lowest point of the vessel in the fluid.

35. The device of claim 31, wherein the lower hollow member forms a hook positionable at a lowest point of the vessel in the fluid.

36. The device of claim 31, the hollow positioning member further comprising:

an upper hollow member having a first open end and a second open end, the first open end operatively connected to the hollow positioning member between the second open end of the hollow positioning member and the lower hollow member, the second open end for receiving fluid from between the vessel and the cover enclosing the vessel portion extending in the fluid.

37. The device of claim 36, wherein the upper hollow member forms a hook positionable below a portion of the vessel in the fluid.

38. A kit for a vessel enclosure comprising:

a container, and;

a device as claimed in claim 1 positioned within the container.

39. The kit of claim 38, wherein the container is a bag.

40. A method of protecting a vessel using a vessel protecting device including (a) a cover for surrounding a vessel in a fluid and attachable solely to the vessel, wherein the cover encloses the vessel portion extending in the fluid and (b) a pump positionable between the cover and the vessel for removing fluid from between the cover and the vessel, wherein the pump is accessible without removing the cover from the vessel and includes a positioning member for positioning the pump between the cover and the vessel, the method comprising:

positioning the cover to surround the vessel in the fluid;

attaching a periphery of the positioned cover to the vessel;

positioning the pump within the cover positioned surrounding the vessel in the fluid after attaching the periphery of the positioned cover to the vessel wherein the positioning the pump comprises positioning the positioning member between the cover and the vessel and positioning a positioning member hook skirt connected to the positioning member between the cover and the vessel;

activating the positioned pump to remove fluid from between the cover and the vessel.

41. The method of claim 40, wherein the cover includes a plurality of openings positioned around a periphery of the cover, and the attaching step comprises:

threading a line through at least one of the plurality of openings to secure the cover to the vessel.

42. The method of claim 40, wherein the positioning member includes a lower member extending from the positioning member at a lower end thereof, and the positioning step further comprises:

positioning the lower member of the positioning member below a lowest level of the vessel portion extending in the fluid.

43. The method of claim 41, wherein the positioning step further comprises:

inserting a buoyant batten in an inverted pocket positioned along a periphery of the cover to position the cover with respect to the vessel.

44. The method of claim 43, wherein the positioning step further comprises cinching the threaded line about the vessel to position the buoyant battens with respect to the vessel.

45. The method of claim 37, wherein the positioning step further comprises:

attaching a buoyant batten to the cover at a location along a periphery of the cover to position the cover with respect to the vessel.

46. The method of claim 43, wherein the positioning step further comprises cinching the threaded line about the vessel to position the buoyant battens with respect to the vessel.

47. A vessel hull protecting device comprising:

a cover positioned surrounding a vessel in a fluid and attached solely to the vessel, wherein the cover encloses the vessel portion extending in the fluid;

a pump positioned between the cover and the vessel for removing fluid from between the cover and the vessel, wherein the pump is accessible without removing the cover from the vessel; and a positioning member, positioned between the cover and the vessel, operatively connected to the pump for positioning the pump relative to the vessel and within the cover, the positioning member further comprising:

a first member positioned substantially vertical and having a first end above the fluid, and;

a second member operatively connected to a second end of the first member away from the first end.

* * * * *